United States Patent [19]

Weiss

[11] Patent Number: 4,828,186

[45] Date of Patent: May 9, 1989

[54] BOAT MOTOR SUPPORT

[75] Inventor: Gordon E. Weiss, New Berlin, Wis.

[73] Assignee: Fulton Manufacturing Corporation, West Allis, Wis.

[21] Appl. No.: 158,515

[22] Filed: Feb. 22, 1988

[51] Int. Cl.[4] ..... F16M 1/00

[52] U.S. Cl. ..... 248/640; 248/642; 267/141; 280/414.1; 440/55; 440/900

[58] Field of Search ..... 248/640, 641, 642, 643, 248/354.1, 354.5, 609, 616; 267/70, 141, 153; 280/414.1; 440/900, 55

[56] References Cited

U.S. PATENT DOCUMENTS

| | | | |
|---|---|---|---|
| 2,023,527 | 12/1935 | Johansen | 267/70 |
| 2,135,112 | 11/1938 | Price | 267/70 |
| 2,782,052 | 2/1957 | Albrecht et al. . | |
| 2,852,883 | 9/1958 | Walsh | 248/616 X |
| 2,901,267 | 8/1959 | Holsclaw | 248/642 X |
| 2,939,670 | 6/1960 | Anderson | 280/414.1 X |
| 2,977,084 | 3/1961 | Brown et al. . | |
| 2,981,222 | 4/1961 | Cunefare . | |
| 3,096,959 | 7/1963 | Wagner . | |
| 3,173,644 | 3/1965 | Burfiend . | |
| 3,416,759 | 12/1968 | Arnett . | |
| 3,693,576 | 9/1972 | Driscoll | 248/642 X |
| 3,698,264 | 10/1972 | York | 267/70 X |
| 3,809,172 | 5/1974 | Hendrickson et al. | 267/141 X |
| 3,859,952 | 1/1975 | Celli | 267/70 X |
| 3,941,344 | 3/1976 | Paterson | 248/642 X |
| 3,952,986 | 4/1976 | Wells | 248/642 x |
| 4,125,236 | 11/1978 | Landwerlen | 248/640 |
| 4,331,431 | 5/1982 | Estes | 248/640 X |
| 4,501,561 | 2/1985 | Speelman | 248/354.5 X |
| 4,650,427 | 3/1987 | Huchinson | 248/354.1 X |
| 4,685,888 | 8/1987 | Brewer | 248/640 X |

*Primary Examiner*—Ramon O. Ramirez

*Attorney, Agent, or Firm*—Edgar A. Zarins; Malcolm L. Sutherland

[57] ABSTRACT

A boat motor support for use in towing a boat on a boat trailer. The support is adapted to provide adjustable absorption of impact loads against either the trailer or the overhung motor itself. The support includes a trailer frame mount bracket at one end and a motor mount bracket at the other end thereof. The support includes telescoping members which may be relatively adjusted to shorten or lengthen the support. A plurality of elastic members are disposed within the telescoping members to cushion the longitudinal movement. The number, size and elasticity of the cushion members can be varied to alter the shock absorption properties of the support. As a result, the boat motor support can accommodate boat motors of different sizes and weights.

19 Claims, 1 Drawing Sheet

Fig-1
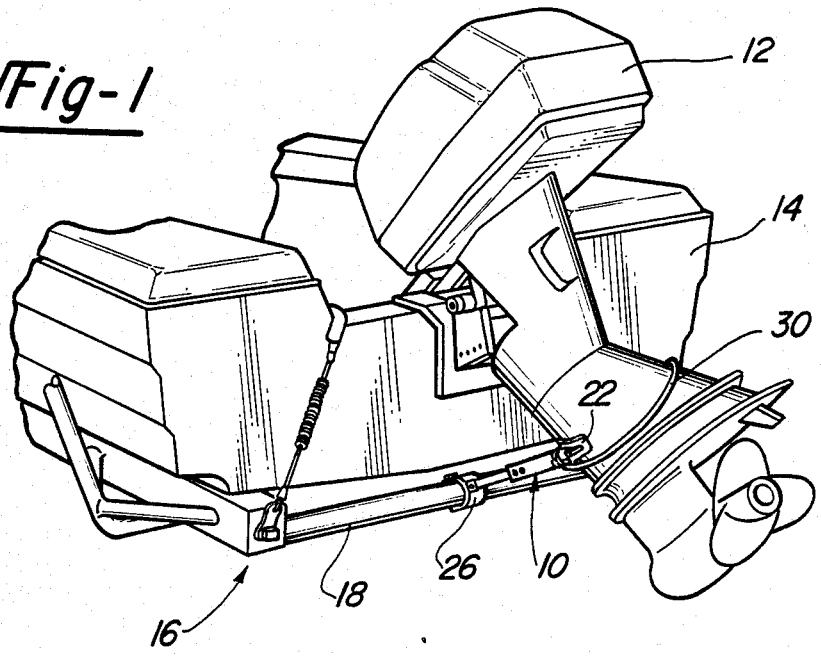
Fig-2
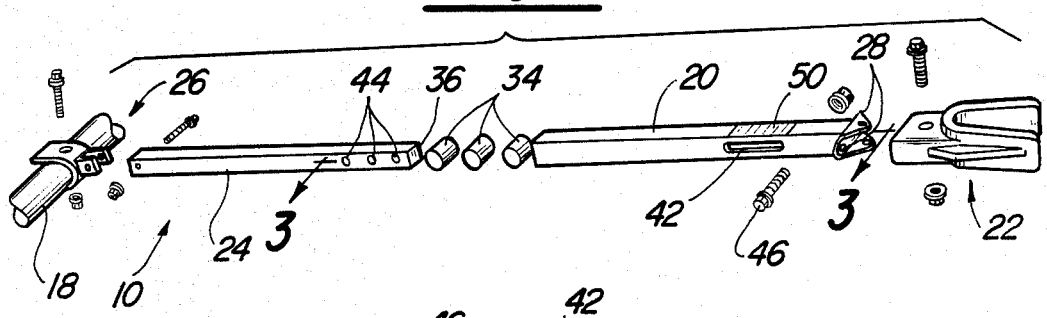
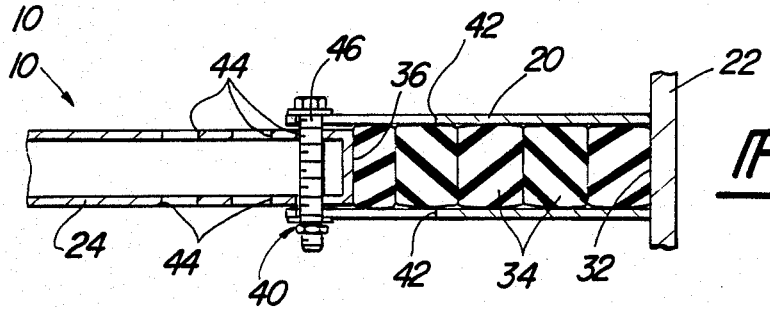
Fig-3
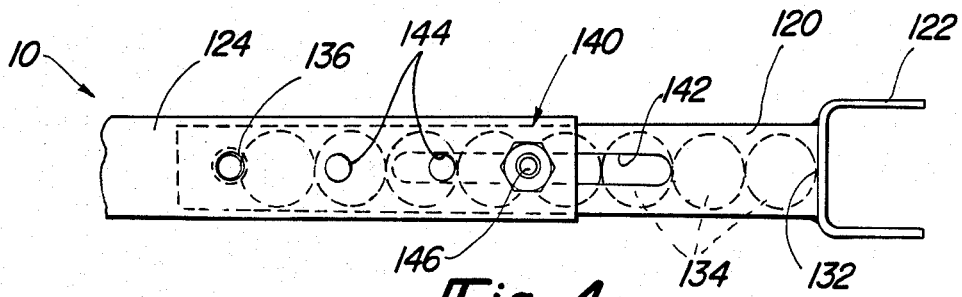
Fig-4

BOAT MOTOR SUPPORT

BACKGROUND OF THE INVENTION

I. Field of the Invention

This invention relates to a bracket for supporting a boat motor in an elevated position during transport by trailer to prevent damage to the motor and the boat transom and, in particular, to a boat motor support which is telescopically adjustable and includes means for absorbing load shocks during transport.

II. Description of the Prior Art

It is desirable to elevate or tilt the motor of a boat during transport by trailer in order to prevent damage to both the motor and the transom of the boat. During trailering the boat and motor are subject to jarring due to the road surface and the motion of the vehicle. Although most boat and motor assemblies are provided with mechanisms to lock the motor in a tilted position, severe jars can release the lock mechanism resulting in damage to the boat and/or motor. To overcome this problem, various devices have been developed to prop the motor away from the boat and trailer.

Many of the early devices comprised rigid devices which extended between the transom of the boat and the lower housing of the boat motor. However, it was found that such assemblies damaged the transom because of the impact loads associated with transporting the boat. Later versions connected the lower end of the support to the trailer such that the impact loads would be transferred to the trailer. These later devices also utilized a substantially rigid one-piece rod to support the motor. With such an assembly, severe or continuous jarring of the boat and trailer may result in damage to the motor due to the bouncing action of the motor. In addition, many of the past known devices involve intricate mounting brackets which complicate mounting and removal of the bracket.

A past known motor support for securing a boat motor in a tilt position during trailering includes a clamp to prevent the motor from kicking upward out of the support. The elongated shaft of the support includes a coiled spring to provide support of the motor housing. The operating length of the support can be changed to accommodate different support distances although the spring tension will also be subsequently changed proportionately. However, following continuous use of the support, the spring may deteriorate retarding operation of the support.

SUMMARY OF THE PRESENT INVENTION

The present invention overcomes the disadvantages of the past known devices by providing a motor support which is easily attached to the boat trailer and the motor while absorbing shocks associated with trailering.

The boat motor support of the present invention includes a substantially hollow telescoping shaft having a trailer frame mounting bracket at one end and a motor mounting bracket at the other end. The shaft includes a smaller-diameter member which is telescopingly received within a larger diameter shaft member in order to permit adjustment of the length of the support. A pair of aligned slots formed in one of the shaft members is adapted to receive a nut and bolt assembly extending through the other of the shaft members in order to assemble the shaft and limit the telescoping movement of the shaft. The nut and bolt assembly may be disposed within any of a series of receiving holes formed along the shaft member in order to vary the length of the support. Disposed within the shaft are a plurality of elastic elements adapted to cushion or absorb the telescoping movement of the shaft. By varying the size, number or elasticity of the elements, the compression rate can be altered to accommodate different applications. In a preferred embodiment of the invention, the cushion elements comprise cylindrical rubber elements captured within either or both shaft portions. Thus, the present invention provides a non-corrosive, relatively quiet and adjustable means of absorbing impact loads of a boat motor in the transport position.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views, and in which:

FIG. 1 is an elevated perspective of the support bracket of the present invention attached to a boat motor and trailer;

FIG. 2 is an exploded view of a first preferred embodiment of the support bracket of the present invention;

FIG. 3 is a partial cross-sectional perspective taken along line 3—3 in FIG. 2; and FIG. 4 is a partial side view of a second preferred embodiment of the support bracket of the present invention.

DETAILED DESCRIPTION OF A PREFERRED EMBODIMENT OF THE PRESENT INVENTION

Referring first to FIG. 1, there is shown a boat motor support bracket 10 embodying the present invention and adapted to support a boat motor 12 in an elevated or tilted position relative to the boat 14 to which it is connected. The boat motor 12 is normally stored in the tilted position during transport of the boat 14 on a boat trailer 16 in order to prevent damage to the lower assembly of the motor 12. Although most motor and boat assemblies are provided with locking mechanisms adapted to maintain the motor 12 in the tilted position, it has been found that such mechanisms can release under severe shock loads. The motor support bracket 10 is adapted to extend between the lower assembly of the motor 12 and a cross frame bar 18 of the trailer 16 to maintain the position of the motor 12. Alternatively, the bracket 10 may be connected to the rear of the boat 14; however, the preferred connection is to the boat trailer 16.

Referring now to FIGS. 2 and 3, there is shown a first embodiment of the support bracket 10 of the present invention. The bracket 10 generally comprises a first bracket member 20 to which is attached a cradle assembly 22 adapted to receive the lower assembly of the boat motor 12 and a second bracket member 24 to which is attached a yoke assembly 26 adapted to be secured to the frame 18 of the boat trailer 16. The cradle assembly 22 is pivotally connected to the outer end of the bracket member 20 to dampen any rocking action of the motor 12 during transport. Formed proximate the cradle 22 at the end of the bracket member 20 are oppositely disposed eyelets 28. The eyelets 28 facilitate connection of a tie-down strap 30 (FIG. 1) to prevent the motor 12 from inadvertently bouncing out of the cradle assembly 22. The bracket members 20 and 24 are telescopically connected such that the length of the bracket 10 can be varied in accordance with the application. Although the drawings show that bracket member 24 is telescopically received within bracket member 20, it is to be understood that the present invention may be constructed such that either bracket member is telescopically received in the other bracket member without substantially changing the operation and advantages of the present invention.

In the embodiment shown in FIGS. 2 and 3, the first bracket member 20 is hollow with an inner abutment surface 32 formed by the end wall of the bracket member 20. The inner abutment surface 32 may be spaced anywhere within the bracket member 20 although sufficient space must be provided to receive at least one elastic cushion element 34 within the bracket member 20. The cushion elements 34 are removably disposed within the bracket member 20 to selectively vary the compression range and ratio of the bracket members while resiliently biasing the relative telescoping movement of the bracket member 20 and 24 as will be subsequently described. In a preferred embodiment, the cushion elements 34 have a cylindrical configuration which provides room for lateral expansion within the bracket member 20 during compression and are made of an elastic material such as rubber. However, the cushion elements 34 can be made of different shapes, sizes, and densities to provide fixed or variable spring rates of compression. The elastic cushion elements 34 are removable for adjustment to different bracket lengths and different flexural strengths as will be more completely described herein.

The bracket member 24 which is telescopically received within the bracket member 20, is provided with a solid or closed end 36 which forms a secondary abutment surface for the cushion elements 34. Once the bracket member 24 is inserted into the bracket member 20, the cushion elements 34 are disposed between the inner abutment surface 32 and the secondary abutment surface 36. The cushion elements 34 are compressed between the surfaces 32 and 36 as the bracket member 24 moves into the bracket member 20. The bracket member 24 may be hollow and provided with the end wall 36 or the bracket member 24 may be solid for additional strength.

Referring still to FIGS. 2 and 3, the relative telescoping movement of the bracket members 20 and 24 is limited by a pin and slot assembly 40. In one possible embodiment, the hollow first bracket member 20 is provided with a pair of longitudinal slots 42 formed on opposite sides of the bracket member 20 while the second bracket member 24 is provided with a plurality of aligned apertures 44 formed on opposite sides of the bracket member 24. A fastener 46 extends through a pair of aligned slots 42 and a pair of aligned apertures 44 to secure the bracket members to each other. The length of these slots 42 determines the maximum relative travel distance of the bracket members. Although one pair of slots 42 is shown, any number of slots 42 may be provided in order to vary the overall length of the support bracket 10. Similarly, by positioning the fastener 46 in a different pair of apertures 44, the length of the support bracket 10 can be varied. In the embodiment of FIGS. 2 and 3, the fastener 46 extends laterally through the bracket members 20 and 24 remote from cushion elements 34.

In the embodiment of FIG. 4, resilient biasing of the bracket members occurs under compression and expansion of the bracket (both occurrences). The bracket 10 includes a bracket member 120 which is telescopically received within a bracket member 124 both of which are substantially hollow. The bracket member 120 includes an inner abutment surface 132; however, the secondary abutment surface is formed by a reaction pin 136 disposed in the opposite end of the bracket member 120. Cushion elements 134 are captured within the bracket member 120 between the inner abutment surface 132 and the reaction pin 136. The pin 136 is removable in order to vary the number of cushion elements 134 or to change the configuration, density, etc. of the cushion elements 134. In order to telescopically connect the bracket members, the bracket member 120 is provided with at least one pair of aligned opposite slots 142 while the bracket member 124 is provided with at least one pair of aligned opposite apertures 144. A fastener 146 extending through a pair of apertures 144 and a pair of slots 142 telescopically connects the bracket members. The length of the slots 142 determine the maximum travel distance of the brackets. The fastener 146 extends laterally through the bracket members between the cushion elements 134 as shown in FIG. 4. In this manner, the fastener 146 acts as an intermediate abutment surface such that during compression of the bracket 10′ both occurrences, the cushion elements 134 between the inner abutment surface 132 and the fastener 146 are resiliently compressed. Similarly, as the bracket 10′ is expanded, the cushion elements 134 between the fastener 146 and the reaction pin 136 are resiliently compressed. Thus, the embodiment of FIG. 4 provides two-way resilient biasing to absorb shock loads.

The present invention provides controlled absorption of shock loads associated with transporting a boat motor 12 connected to the boat 14 and supported in an elevated position. The bracket 10 is connected to the boat trailer 16 using the yoke assembly 26 while the lower housing of the motor 12 is positioned within the cradle 22. A tie strap 30 is connected to the cradle assembly 22 to prevent the motor 12 from bouncing out of the cradle 22. Preferably, the bracket 10 has been preassembled to accommodate the size and weight of the motor 12 by utilizing the proper number of cushion elements 34 or 134. However, if it is found that the bracket 10 is overly compressed because of the weight of the motor 12 or if the length of the bracket 10 must be varied to properly elevate the boat motor 12, the bracket 10 must be disconnected at least from the motor 12. To vary the length of the bracket 10, the fastener 46 or 146 is removed and placed through a new set of apertures 44, 144 and/or slots 42, 142. If it is determined that more or fewer cushion elements are required to accommodate the new length, the number of elements 34, 134 is varied prior to assembly of the bracket members. Similarly, if it is desired to vary the compression range of the bracket 10, the number, shape or type of cushion elements can be varied. Since the slots 42, 142 preferably span a plurality of cushion elements 34, 134, one or two elements can be removed without substantially changing the length of the bracket 10. In addition, an indicia label 50 may be attached proximate the slot to provide an indication of the proper compression of the bracket 10.

With the length and compression range of the bracket 10 set for the size and weight of the boat motor 12 and the bracket 10 attached to the boat trailer 16 and the motor 12, the boat 14 and motor 12 can now be safely transported. In both embodiments, when a momentary load is placed downwardly upon the bracket 10 by the motor 12, the bracket member 24 will telescopically extend into the bracket member 20 compressing the elements 34. However, the resilient properties of the elements 34 will absorb the shock load and bias the bracket 10 towards its normal or at-rest position. In this manner, such bouncing shock loads do not result in damage to the boat motor 12 which could be caused by a rigid support.

With the embodiment of FIG. 4, in the case of an upward load caused possibly by tension on the tie strap 30, the bracket is again biased to its normal position, As the upward load causes extension of the bracket 10' the cushion elements 134 between the reaction pin 136 and the fastener 146 will be compressed. Again the resilient nature of the elements 134 will bias the bracket 10' to its normal position. Thus, the bracket 10' is capable of absorbing both upward and downward shock loads exerted between the motor 12 and the trailer 16.

The foregoing detailed description has been given for clearness of understanding only and no unnecessary limitations should be understood therefrom as some modifications will be obvious to those skilled in the art without departing from the scope and spirit of the appended claims.

I claim:

1. A bracket for supporting a boat motor in an elevated position during transport of the boat on a trailer, said bracket attachable to the boat motor and the boat trailer, said bracket comprising:

a hollow bracket member having an inner abutment surface;

another bracket member telescopically cooperating with said hollow bracket member; and at least one resiliently compressible cushion member removably disposed within said hollow bracket member between said inner abutment surface and a secondary abutment surface, said at least one cushion member resiliently biasing the relative telescoping movement of said bracket members, said resilient biasing of the relative telescoping movement of said bracket members being selectively variable by varying the number of cushion members disposed between said inner abutment surface of said hollow bracket member and said secondary abutment surface.

2. The bracket as defined in claim 1 wherein said at least one cushion comprises an elastic element.

3. The bracket as defined in claim 2 wherein said elastic element has a substantially cylindrical configuration, said resilient biasing being selectively variable by varying the material properties of said elastic element.

4. The bracket as defined in claim 2 and further comprising means for limiting the relative telescoping movement of said bracket members, said limiting means being selectively adjustable proportionately to said selectively variable, resilient biasing.

5. The bracket as defined in claim 4 wherein said limiting means includes at least one pair of aligned longitudinal slots formed in one of said bracket members, and at least one pair of aligned apertures formed in the other of said bracket members, said limiting means comprising a fastener means extending through an aligned pair of apertures and an aligned pair of slots to telescopically secure said bracket members, said fastener means extending laterally through said bracket members.

6. The bracket as defined in claim 5 wherein said secondary abutment surface is formed by the end of said other bracket member, said other bracket member being telescopically received within said hollow bracket member wherein said at least one cushion member is resiliently compressible between the end of said other bracket member and said inner abutment surface of said hollow bracket member.

7. The bracket as defined in claim 5 wherein said secondary abutment surface comprises a reaction pin laterally disposed within one of said bracket members.

8. The bracket as defined in claim 7 wherein said reaction pin is disposed within said hollow bracket member, said at least one cushion member being disposed between said inner abutment surface and said reaction pin, said hollow bracket member being telescopically received within said other bracket member.

9. The bracket as defined in claim 8 wherein said fastener means extends through said bracket members intermediate said inner abutment surface and reaction pin, at least one cushion member being compressibly disposed between said reaction pin and said fastener means and at least one cushion member being compressibly disposed between said fastener means and said inner abutment surface.

10. The bracket as defined in claim 5 wherein the other of said bracket members includes a plurality of aligned apertures for variable adjustment of the length of said bracket.

11. The bracket as defined in claim 1 wherein one of said bracket members includes means for receiving the boat motor formed at an outer end thereof and the other of said bracket members includes means for attaching said bracket to the boat trailer.

12. The bracket as defined in claim 11 and further comprising indicia means showing the compression range of said bracket, said indicia means disposed proximate said aligned longitudinal slot.

13. A bracket for supporting a boat motor in an elevated position during transport of the boat on a trailer, said bracket attachable to the boat motor and the boat trailer, said bracket comprising:

a first hollow bracket member having an inner abutment surface;

a second bracket member telescopically received within said first bracket member, said second bracket member having an end abutment surface;

at least one resiliently compressible cushion member removably disposed within said hollow bracket member between said inner abutment surface of said first bracket member and said end abutment surface of said second bracket member, said at least one cushion member resiliently biasing the relative telescoping compression of said bracket members, said resilient biasing of the relative telescoping movement of said bracket members being selectively variable by varying the number of cushion members disposed between said abutment surfaces; and means for limiting the relative telescoping compression of said bracket members, said limiting means being selectively adjustable to vary the length of said bracket.

14. The bracket as defined in claim 13 wherein said limiting means includes t least one pair of aligned opposite longitudinal slots formed in one of said bracket members and at least one pair of aligned opposite apertures formed in the other of said bracket members, said limiting means comprising a fastener means extending through an aligned pair of apertures and an aligned pair of slots to telescopically secure said bracket members, said fastener means extending laterally through said bracket members remote from said cushion members.

15. The bracket as defined in claim 13 wherein said hollow bracket member includes means for attaching said bracket to the boat motor formed at the remote end thereof and said second bracket member includes means for attaching said bracket to the boat trailer formed at the remote end thereof.

16. A bracket for supporting a boat motor in an elevated position during transport of the boat on a trailer, said bracket attachable to the boat motor and the boat trailer, said bracket comprising:

a first hollow bracket member;

a second hollow bracket member having an inner abutment surface and a secondary abutment surface, said second hollow bracket member being telescopically received within said first hollow bracket member;

a plurality of resiliently compressible cushion members removably disposed within said second hollow bracket member between said inner abutment surface and said secondary abutment surface; and means for limiting the relative telescoping movement of said bracket members, said limiting means being selectively adjustable to vary the length of said bracket;

said limiting means disposed intermediate said inner abutment surface and said secondary abutment surface, at least one cushion member compressibly disposed between said inner abutment surface and said limiting means and at least one cushion member compressibly disposed between said limiting means and said secondary abutment surface, said cushion members resiliently biasing the relative telescoping movement of said bracket members, said resilient biasing of the relative telescoping movement of said bracket members being selectively variable.

17. The bracket as defined in claim 16 wherein said resilient biasing is selectively variable by varying the number of cushion members disposed between said inner abutment surface and said limiting means and between said limiting means and said secondary abutment surface.

18. The bracket as defined in claim 17 wherein said limiting means includes at least one pair of aligned opposite longitudinal slots formed in one of said bracket members and at least one pair of aligned opposite apertures formed in the other of said bracket members, said limiting means comprising a fastener means extending through an aligned pair of apertures and an aligned pair of slots to telescopingly secure said bracket members, said fastener means extending laterally through said bracket members between said cushion members.

19. The bracket as defined in claim 16 wherein one of said bracket members includes means for attaching said bracket to the boat motor formed at the remote end thereof and the other of said bracket members includes means for attaching said bracket to the boat trailer formed at the remote end thereof.

* * * * *